US006210180B1

(12) United States Patent
Lee et al.

(10) Patent No.: US 6,210,180 B1
(45) Date of Patent: Apr. 3, 2001

(54) RETENTION DEVICE FOR CONNECTOR

(75) Inventors: Wei-Chen Lee, Taipei; Chih-Ming Chien, Tu-Chen, both of (TW)

(73) Assignee: Hon Hai Precision Ind. Co., Ltd., Taipei (TW)

( * ) Notice: Subject to any disclaimer, the term of this patent is extended or adjusted under 35 U.S.C. 154(b) by 0 days.

(21) Appl. No.: 09/468,768

(22) Filed: Dec. 10, 1999

(51) Int. Cl.[7] ..... H01R 12/20
(52) U.S. Cl. ..... 439/79; 439/943
(58) Field of Search ..... 439/752, 79, 943

(56) References Cited

U.S. PATENT DOCUMENTS 5,433,624 * 7/1995 Tabata ..... 439/79
5,453,016 * 9/1995 Clark et al. ..... 439/79
5,743,765 * 4/1998 Andres et al. ..... 439/79
5,785,537 * 7/1998 Donahue et al. ..... 439/79
5,794,336 * 7/1995 Hopson et al. ..... 439/79

* cited by examiner

*Primary Examiner*—Gary F. Paumen
(74) *Attorney, Agent, or Firm*—Wei T. Chung

(57) ABSTRACT

An electrical connector comprises a dielectric housing, a number of terminals received in the housing, an insulative spacer and a retainer supportingly attached to the spacer. The terminals each comprise a base, an engaging end forwardly extending from the base, a neck rearwardly extending from the base, and a shoulder intermediate the neck and a leg for mating with a circuit board. The spacer includes a number of uniformly spaced apart dividers, each divider defining a pair of channels at rear corners thereof whereby defining a pair of rearwardly facing abutment walls. The dividers are interposed between the necks of adjacent terminals thereby the abutment walls bear against the shoulders of the terminals for preventing their forward movements.

1 Claim, 4 Drawing Sheets

RETENTION DEVICE FOR CONNECTOR

BACKGROUND OF THE INVENTION

1. Field of the Invention

The present invention relates to a connector, and particularly to a connector having a retention member for securing a plurality of terminals in position during assembly.

2. Brief Description of the Prior Art

A retention member of a contact of a female connector is desired to secure the contact in position when the female connector is mated with a male connector in one direction and when the female connector is mounted onto a circuit board in an another direction. A conventional contact is usually secured by a plurality of barbs thereof interferentially engaging with a passageway therearound. However, such a retention member of the contact of the female connector, such as the plurality of barbs, can more reliably retain the contact when the male connector is inserted into the female connector than it can when the female connector is mounted onto a circuit board. Insertion force of the female connector into the circuit board is greater than a reaction force resulted from insertion of a male connector into the female connector, which aggravates a requirement for a retention member that can secure the contact in opposite directions.

Hence, an improved electrical connector is required to overcome the disadvantages of the prior art.

BRIEF SUMMARY OF THE INVENTION

A first object of the present invention is to provide a connector with a retention member which can secure contacts of the connector in position;

A second object of the present invention is to provide terminals which are adapted to be secured by the retention member.

To achieve the above objects, a connector includes a dielectric housing, a plurality of terminals received in the housing, a spacer for securing the terminals, and a retainer for supporting the spacer.

The terminals each has a base, an engaging end extending forwardly from the base, a neck projecting rearwardly from the base, a shoulder intersecting the neck and a leg for mounting the connector on a circuit board. The spacer includes a plurality of uniformly spaced dividers and a pair of latches and posts at bottom of the dividers. Each of the dividers defines a pair of elongate channels at rear corners thereof. Each channel opens toward a front side of the divider and toward a lateral side of the divider whereby defining a front wall face of an abutment wall. The retainer defines a pair of apertures and holes for respectively receiving the pair of posts and latches of the spacer whereby being upwardly attached to the spacer.

The spacer can also configure with some elongate dividers whose heights are equal to that of the housing, so it can support itself without the retainer.

In assembly, the terminals are forwardly received in the housing while the necks extend beyond the housing. The spacer is then pushed downwardly from upwardly of the housing while the dividers thereof wedge between the necks. Moreover, the shoulders of the terminals are fixed between the corresponding channels and press against the abutment walls of the dividers. The retainer is attached to the spacer upwardly from a bottom of the spacer for supporting the spacer.

During an engagement with a complementary connector, the terminals of the connector are retained in position by the barbs. However, the terminals are secured by the shoulders thereof fitting against the abutment walls of the dividers when the legs extend into corresponding through holes in a circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
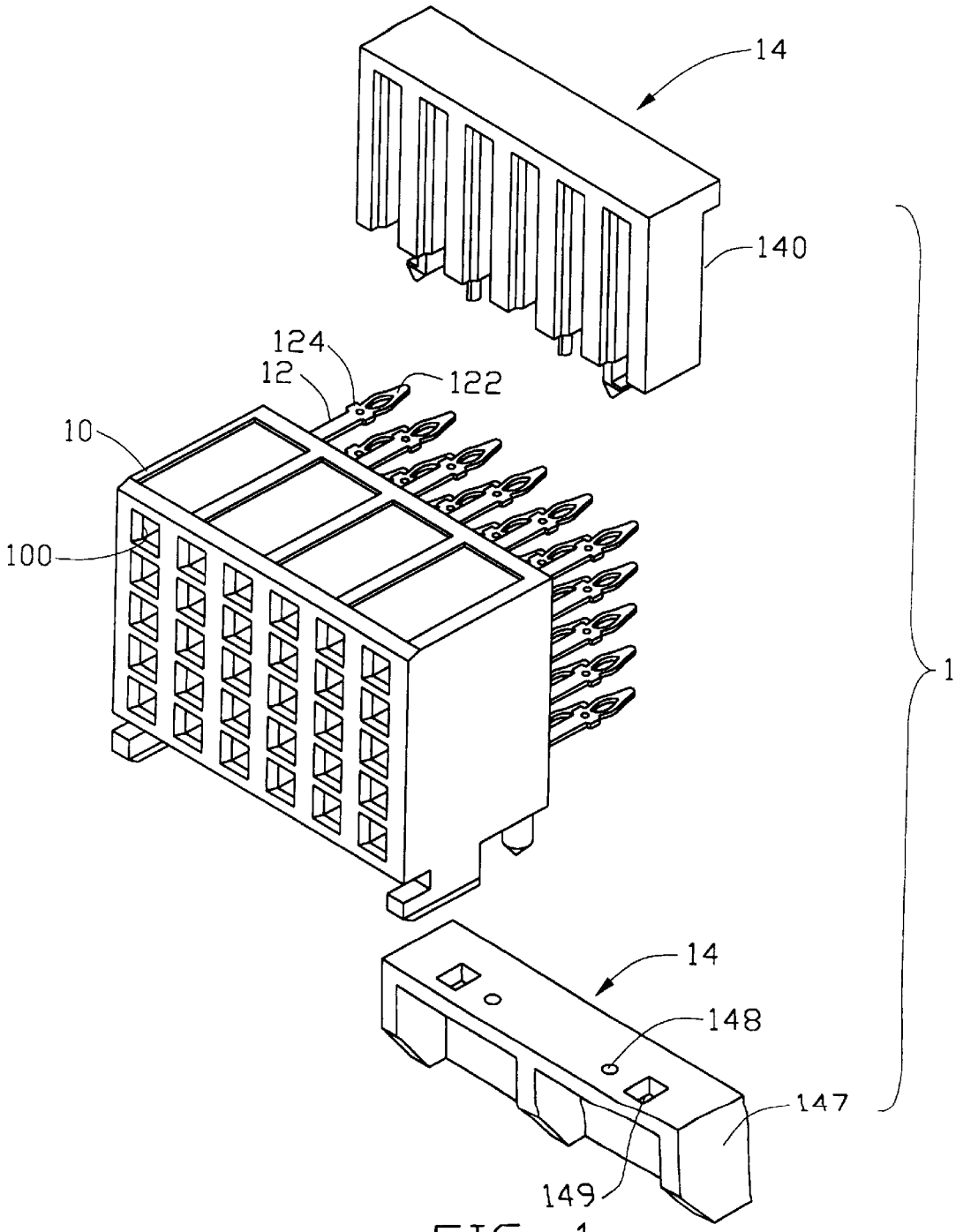
FIG. 1 is an exploded view of an electrical connector in accordance with the present invention.

Referring to FIG. 1, an electrical connector 1 comprises a dielectric housing 10 receiving a plurality of terminals 12 therein, a spacer 140 and a retainer 147.

The elongate housing 10 includes a plurality of receiving passages 100 for receiving the plurality of terminals 12. The receiving passages 100 extend through the housing 10 and thus the terminals 12 can forwardly extend into the passages 100 from rearwardly of the housing 10.

Figure 3:
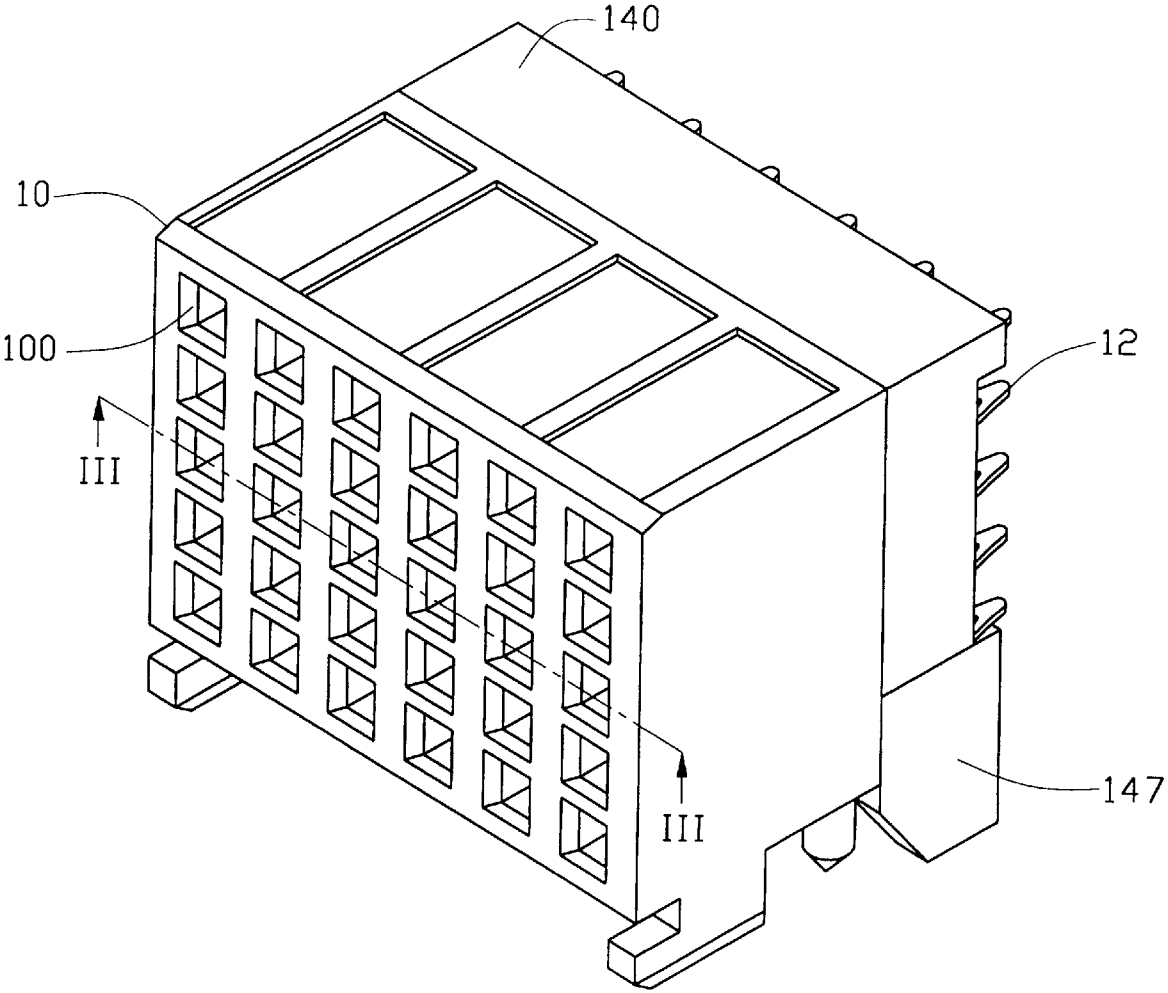
FIG. 3 is an assembled view of the connector of FIG. 1.

The terminals 12, also referring to FIG. 3, each has a base 121, an engaging end 120 extending forwardly from an end of the base 121 for mating with a complementary connector (not shown), an intermediate neck 125 extending rearwardly from an opposite end of the base 12, a shoulder 124 intersecting with the neck 125, and a leg 122 rearwardly extending from the shoulder 124 for contacting a circuit board (not shown). The base 121 fits with the receiving passage 100 and forms a barb 123.

Figure 2:
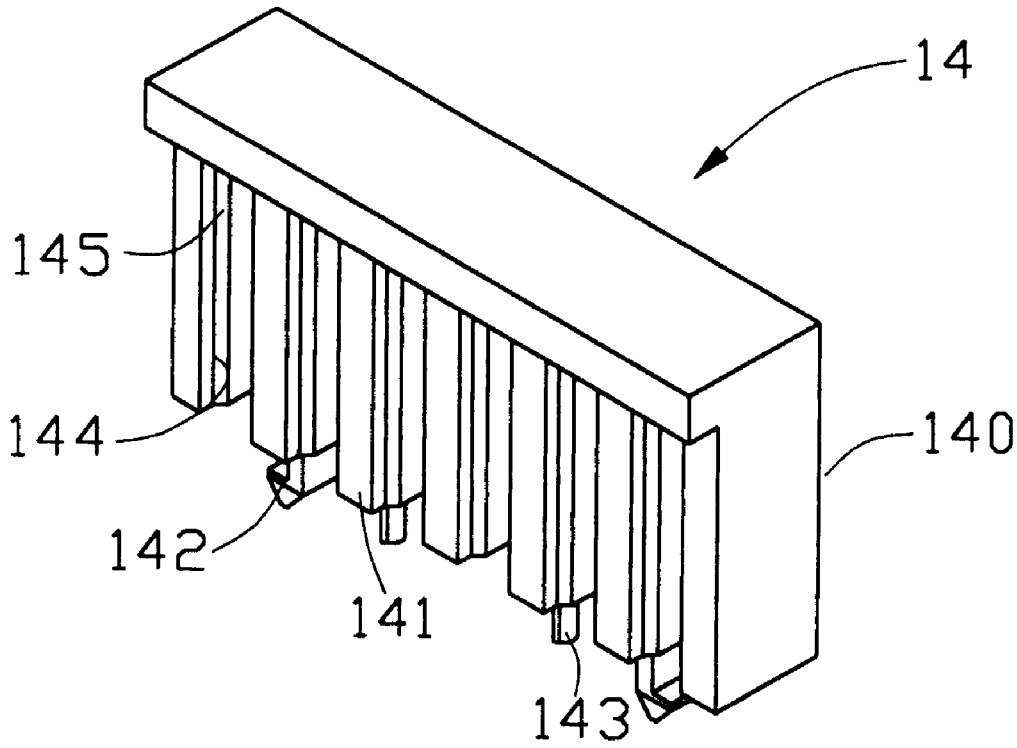
FIG. 2 is an exploded view of a spacer of FIG. 1 showing a rear side of the spacer.

The dielectric spacer 140, referring to FIG. 2, has a plurality of elongate dividers 141 extending from a bottom thereof proximate to a top end thereof. The dividers 141 are uniformly spaced apart and each of the dividers 141 defines a pair of elongate channels 144 in two rear comers thereof (see FIG. 3). Each channel 144 opens toward a rearward side of the divider 141 and toward a lateral side of the divider 141, a rearwardly facing abutment wall 145 in the divider 141 defining the channel 144. Two latches 142 and posts 143 respectively extend downwardly from the dividers 141.

The retainer 147 equals the spacer 140 in width and defines two holes 149 and apertures 148 in a top wall thereof for respectively engaging with the latches 142 and the posts 143 whereby attaching the retainer 147 to the spacer 140. Heights of the retainer 147 and the spacer 140 add up to that of the housing 10.

Figure 4:
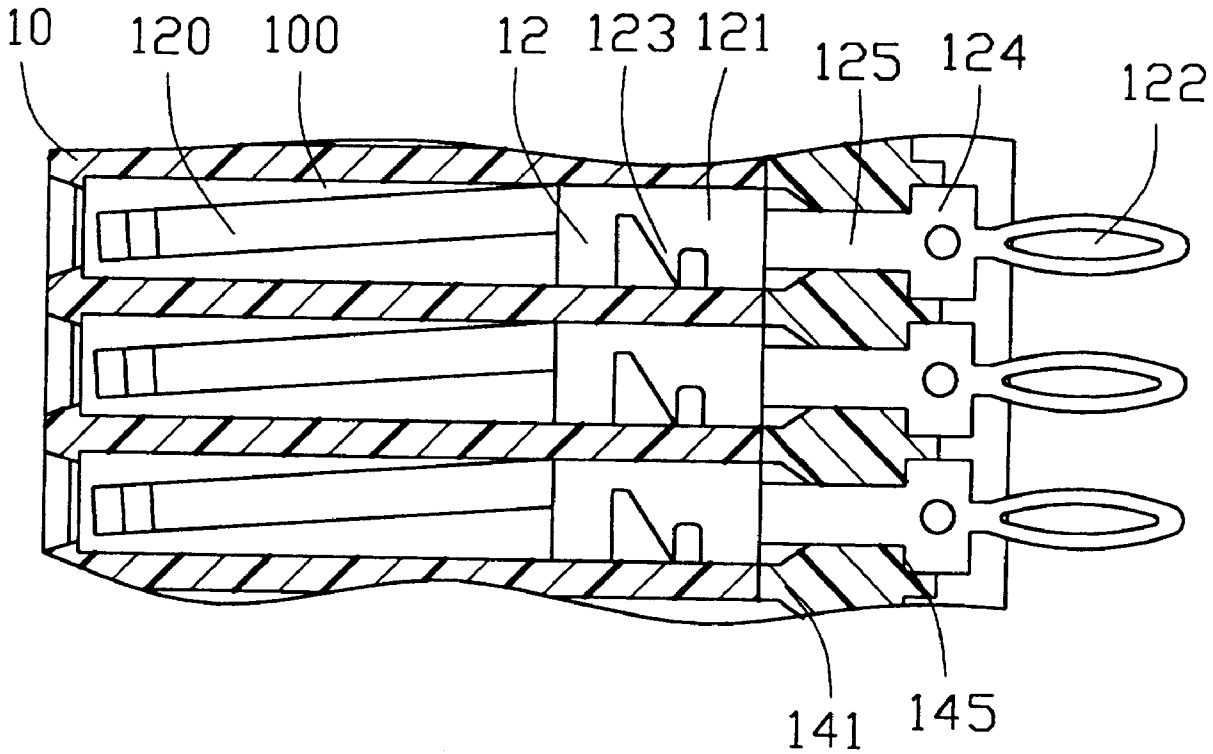
FIG. 4 is a partially sectional view of the connector of FIG. 3 taken along IV—IV.

In assembly, referring to FIGS. 3 and 4, the terminals 12 are inserted into the receiving passages 100 forwardly from rear portion of the housing 10. The barbs 123 of the terminals 12 interferentially mate with respective receiving passages 100 and the bases 121 fit with the receiving passages 100 thereby the terminals 12 are retained in the receiving passages 100. The necks 125 of the terminals 12 extend beyond the housing 10. The spacer 140 is then pushed downwardly from above of the housing 10 while the necks 125 are fixed between adjacent dividers 141. The shoulders 124 of the terminals 12 are pressed against the abutment walls 145 of the dividers 141 and held between the adjacent channels 144.

The retainer 147 is then attached to the spacer 140 upwardly from underside of the spacer 140 in such a way that the apertures 148 mate with the post 143 and the holes 149 interlock with the latches 143. Since the height of the spacer 140 and the retainer 147 equal to that of the housing 10, the retainer 147 supports the spacer 140.

The spacer 140 can also configure with some of elongate dividers 141 whose lengths equal to that of the housing 10. Therefore, the spacer 140 supports itself without the retainer 147.

When the legs 122 extend through a plurality of through holes in a circuit board (not shown), the abutment walls 145 bear against the shoulders 124 thereby preventing the terminals 12 from longitudinal movement. The shoulders 124 held between the channels 144 are further precluded from transverse movement by the channels 144. The barbs 123 of the bases 121 interferentially engage with the receiving passages 100 and thus additionally constrain the terminals 12 in position. The terminals 12 are fixedly secured when the connector 1 is mounted onto the circuit board (not shown). As well known to us, the barbs 123 are able to secure the terminals 12 in position when the connector 1 engages with the complementary connector (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising an insulative housing defining a plurality of receiving passages, a plurality of terminals received in the receiving passages, and a spacer having a plurality of spaced apart dividers, the terminals each including a base, an engaging end extending from the base for contacting with a mated connector, a neck extending from the base, and a leg, wherein:

each of the plurality of terminals has a shoulder between the neck and the leg; and each of the dividers defines two abutment walls at lateral sides thereof for bearing against the shoulder of the corresponding terminal to prevent a forward movement of the terminal;

wherein each divider is interposed between the necks of adjacent terminals in a direction substantially perpendicular to the terminals;

wherein the divider defines a pair of channels respectively at a corner thereof, each channel defining a front wall face of the abutment wall;

wherein the spacer has a height substantially equal to that of the housing, further comprising a retainer supportingly attached to the spacer;

wherein the spacer further includes a pair of latches and posts, and wherein the retainer has a pair of holes for interlocking with the latches and a pair of apertures for mating with the posts;

wherein a combined height of the spacer and the retainer is essentially equal to that of the housings.

* * * * *